US009651246B2

(12) United States Patent
Chen

(10) Patent No.: US 9,651,246 B2
(45) Date of Patent: May 16, 2017

(54) SAFE COMBUSTION DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 744 days.

(21) Appl. No.: 14/055,940

(22) Filed: Oct. 17, 2013

(65) Prior Publication Data

US 2014/0162202 A1 Jun. 12, 2014

(30) Foreign Application Priority Data

Dec. 11, 2012 (TW) ..... 101146728 A
Sep. 5, 2013 (TW) ..... 102131976 A

(51) Int. Cl.

| | |
|---|---|
| ***F23D 3/18*** | (2006.01) |
| ***F23D 3/24*** | (2006.01) |
| ***F23D 3/04*** | (2006.01) |
| ***F23D 3/08*** | (2006.01) |
| ***F23D 3/20*** | (2006.01) |
| ***F23D 3/22*** | (2006.01) |
| ***F23D 3/40*** | (2006.01) |

(52) U.S. Cl.

CPC ..... *F23D 3/24* (2013.01); *F23D 3/04* (2013.01); *F23D 3/08* (2013.01); *F23D 3/20* (2013.01); *F23D 3/22* (2013.01); *F23D 3/40* (2013.01)

(58) Field of Classification Search

CPC ..... F23D 3/00; F23D 3/02; F23D 3/18; F21V 37/00; F21V 37/002

USPC ..... 431/298, 309–314, 320; 362/159

See application file for complete search history.

(56) References Cited

U.S. PATENT DOCUMENTS

| | | | | |
|---|---|---|---|---|
| 167,236 A * | 8/1875 | Gates | F23D 3/40 | 126/45 |
| 173,101 A * | 2/1876 | Blood | F23D 3/40 | 431/299 |
| 246,686 A * | 9/1881 | Paull | F24C 5/06 | 126/275 R |

(Continued)

FOREIGN PATENT DOCUMENTS

| | | |
|---|---|---|
| CN | 201180916 Y | 1/2009 |
| CN | 202303367 U * | 7/2012 |

(Continued)

OTHER PUBLICATIONS

CN 202303367 U; English machine translation attached.*

*Primary Examiner* — Jorge Pereiro
(74) *Attorney, Agent, or Firm* — Alan D. Kamrath; Kamrath IP Lawfirm, P.A.

(57) ABSTRACT

A safe combustion device includes a housing. A wick is disposed in the housing. The wick has a top end at a first distance from a bottom surface of the housing. A guiding device is connected to the housing and includes at least one shade. The at least one shade has bottom and top sides at second and third distances from the bottom surface of the housing respectively. The second distance is shorter than the first distance. The first distance is shorter than the third distance. The at least one shade has an inner lateral side adjacent to the wick. The at least one shade and the housing include a flow passage formed therebetween.

17 Claims, 18 Drawing Sheets

(56) References Cited

U.S. PATENT DOCUMENTS 367,256 A * 7/1887 West ..... F23D 3/40 431/299
422,758 A * 3/1890 Finch ..... F24C 5/06 126/45
511,737 A * 12/1893 DeMooy, Jr. et al. .... F24C 5/20 126/49
617,291 A * 1/1899 Jeavons ..... F23D 5/00 126/45
669,510 A * 3/1901 Culver ..... F23D 3/00 126/45
1,082,178 A 12/1913 Spear
1,193,146 A * 8/1916 Hoffman ..... F21V 37/00 431/325
2,580,377 A * 12/1951 Patton ..... A45D 1/20 126/229
3,040,804 A * 6/1962 Haslehurst ..... F23Q 7/08 431/262
3,724,756 A * 4/1973 Maltenfort ..... B65D 51/32 239/44
4,557,687 A * 12/1985 Schirneker ..... F23D 3/02 126/96
4,624,633 A * 11/1986 Bandel ..... C10L 1/02 126/265
4,735,568 A * 4/1988 Izumisawa ..... F23D 3/08 431/298
5,309,338 A * 5/1994 Liu ..... A61L 9/122 362/253
5,829,966 A * 11/1998 Stoner ..... F23D 3/02 431/320
6,802,707 B2 10/2004 Furner et al.
6,848,901 B1 * 2/2005 Matsuyama ..... F23D 3/18 431/310
6,960,320 B1 11/2005 Smith et al.
6,991,453 B2 * 1/2006 Decker ..... A61L 9/037 126/45
D584,431 S * 1/2009 Meise ..... D26/11
7,568,913 B2 * 8/2009 Decker ..... A61L 9/037 431/298
8,435,029 B2 * 5/2013 Masterson ..... F23D 3/18 431/312
9,074,763 B2 * 7/2015 Begg ..... F23Q 25/00
2004/0008509 A1 * 1/2004 Decker ..... A61L 9/037 362/159
2005/0037307 A1 * 2/2005 Decker ..... A61L 9/037 431/320
2005/0042566 A1 * 2/2005 Matsuyama ..... F23D 3/18 431/310
2009/0214997 A1 * 8/2009 Stellema ..... F23D 3/18 431/323
2009/0238717 A1 * 9/2009 Nolan ..... F23D 3/24 422/5
2010/0040990 A1 * 2/2010 Paul ..... A47J 36/30 431/323
2010/0062382 A1 * 3/2010 Carey Stachowski .... F23D 3/08 431/144
2011/0097676 A1 4/2011 Masterson et al.
2013/0084533 A1 * 4/2013 Begg ..... F23Q 25/00 431/2
2014/0162202 A1 6/2014 Chen
2014/0193759 A1 * 7/2014 Weber ..... F23C 7/06 431/314

FOREIGN PATENT DOCUMENTS

CN 202561745 U 11/2012
FR 625704 A 8/1927
JP S5575105 A 6/1980
JP S58130904 A 8/1983
TW M267418 U 6/2005
TW M431289 U 6/2012
WO 2005077426 A1 8/2005

* cited by examiner

SAFE COMBUSTION DEVICE

BACKGROUND OF THE INVENTION

1. Field of the Invention

The present invention relates to a combustion device and, particularly, to a safe combustion device.

2. Description of the Related Art

Conventional combustion devices are characterized to two types. A combustion device having no wick(s) is one type, like a fireplace using bioalcohol as fuel, and a combustion device having wick(s) is another type. However, there has always been a problem about the safety of using bioalcohol because it is flammable, and it is difficult to keep the size of the flame in control. Therefore, the combustion devices, which use flammable fuels and have wicks, can be ignited from the wicks rather than from the flammable fuel directly, and the size of the flames is in control. Generally, the combustion device, which has a wick, includes a plate, and the wick is disposed on the plate and has an end dangled into a reservoir for the fuel. The plate is resistant to heat. The wick is generally made up of cotton fibers. For instance, an alcohol burner includes a container in which the alcohol fuel is stored and a wick having one end disposed outside the container and another end soaked into the alcohol fuel. The wick can draw the fuel by capillary action up into the flame. In addition, the container is enclosed.

U.S. Pat. No. 6,960,320 protects an oil burning lamp. The oil burning lamp includes an enclosed reservoir. A wick is disposed in the reservoir and includes an end soaked in and another end disposed outside the fuel. A shade surrounds the wick to avoid outside air blowing onto the wick and putting out the flame. The shade has an opening, and its effect on safeguarding the wick against the outside air is decreased when the opening is too big. The shade, however, causes poor heat dissipation and obstructs a supply of the outside air if the opening is too small. Moreover, poor heat dissipation causes the temperature of the shield to become too hot to touch safely, and a lack of sufficient outside air causes an incomplete combustion and creates black and poisonous smoke. Moreover, because of the poor air ventilation, the heat emitted by the oil burning lamp and the heat dissipation is not in balance, with the longer use time of the oil burning lamp the higher temperature it will get.

In addition, nonflammable fuel and flammable fuel have different flash points. Nonflammable fuel has higher flash points than flammable fuel. It is harder to ignite nonflammable fuel than flammable fuel. However, if the temperature of the oil burning lamp is higher than the flash points of nonflammable fuel, nonflammable fuel can vaporize easily like flammable fuel and is at a higher risk of backdraft and flashover. Accordingly, the size of the flame created by the oil burning lamp is generally small, in order to prevent the oil burning lamp from getting hotter than the flash point of fuel.

The present invention is, therefore, intended to obviate or at least alleviate the problems encountered in the prior art.

SUMMARY OF THE INVENTION

According to the present invention, a safe combustion device includes a housing defining a receiving space. A wick is disposed in the receiving space. The wick has a top end at a first distance from a bottom surface of the housing. A guiding device is connected to the housing and includes at least one shade. The at least one shade has bottom and top sides at second and third distances from the bottom surface of the housing respectively. The second distance is shorter than the first distance. The first distance is shorter than the third distance. The at least one shade has an inner lateral side adjacent to the wick and an outer lateral side opposite the inner lateral side. The at least one shade and the housing include a flow passage formed therebetween. The flow passage has a length between the inner lateral side of the at least one shade and the wick, a length below the bottom side of the at least one shade, and a length outside the outer lateral side of the at least one shade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide a safe combustion device.

It is another object of the present invention to provide a safe combustion device that can produce a flame of a greater size and height.

Other objects, advantages, and new features of the present invention will become apparent from the following detailed description of the invention when considered in conjunction with the accompanied drawings.

DETAILED DESCRIPTION OF THE INVENTION

Figure 1:
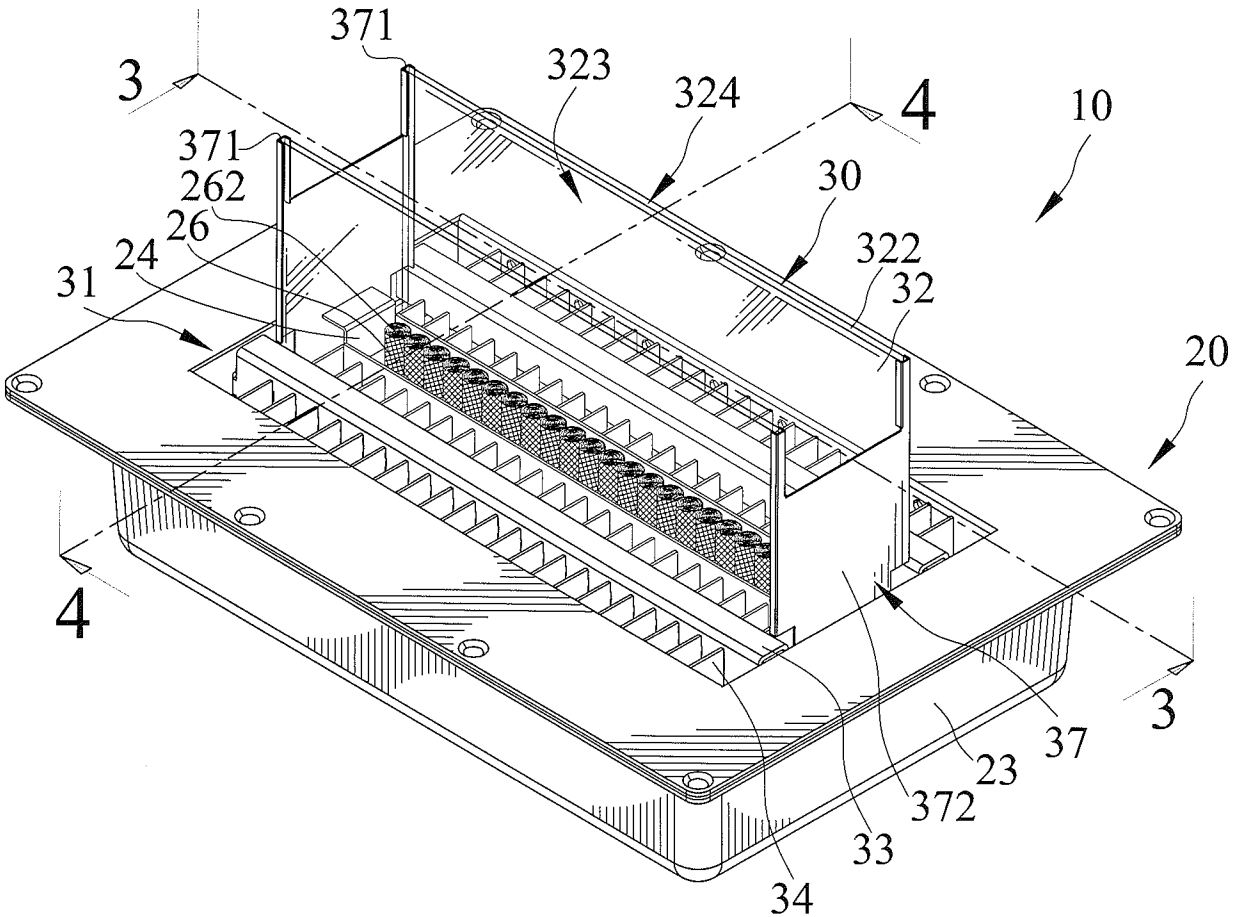
FIG. 1 is a perspective view of a safe combustion device in accordance with a first embodiment of the present invention.
Figure 2:
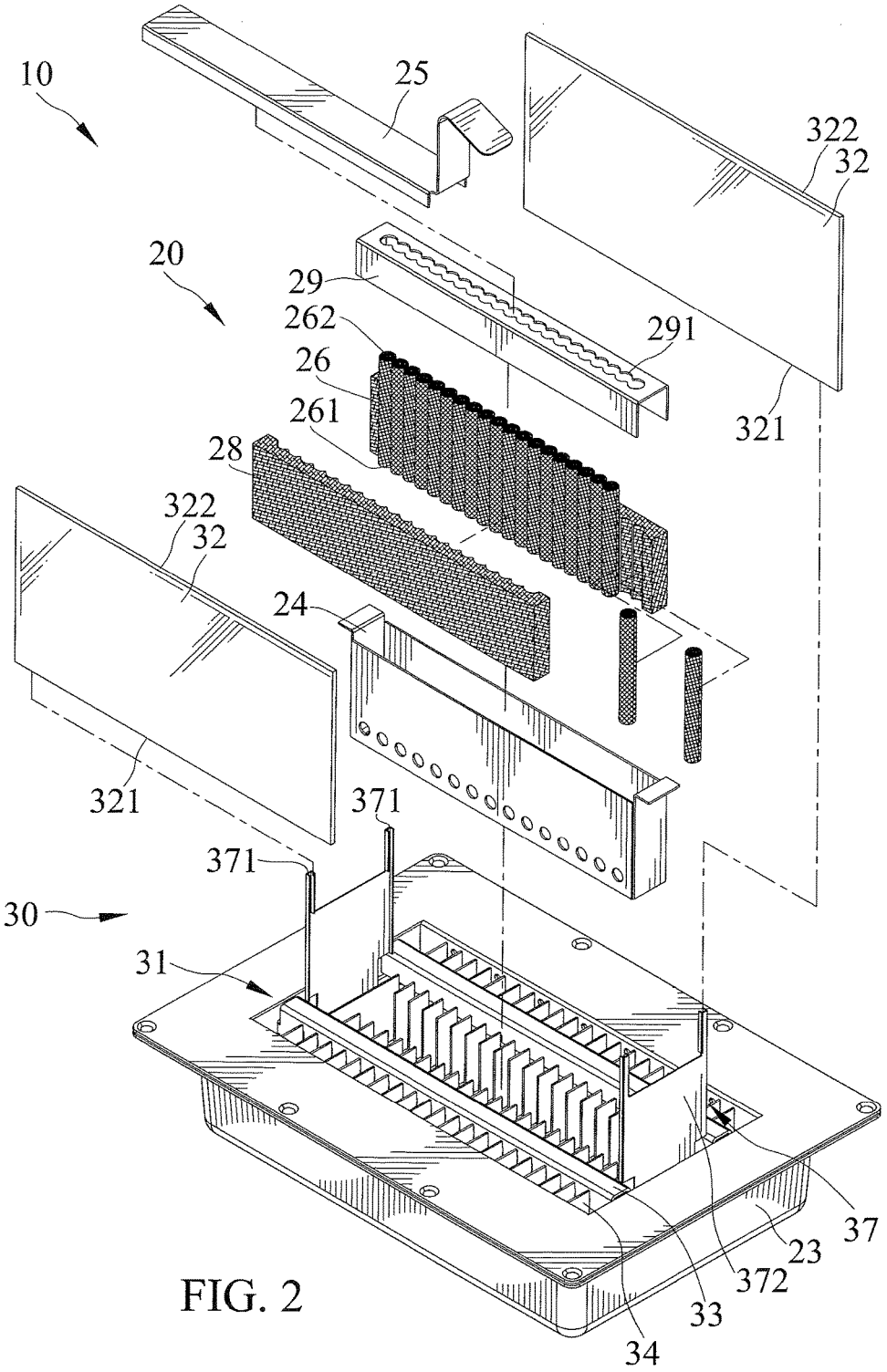
FIG. 2 is an exploded perspective view of the safe combustion device in accordance with the first embodiment of the present invention.
Figure 3:
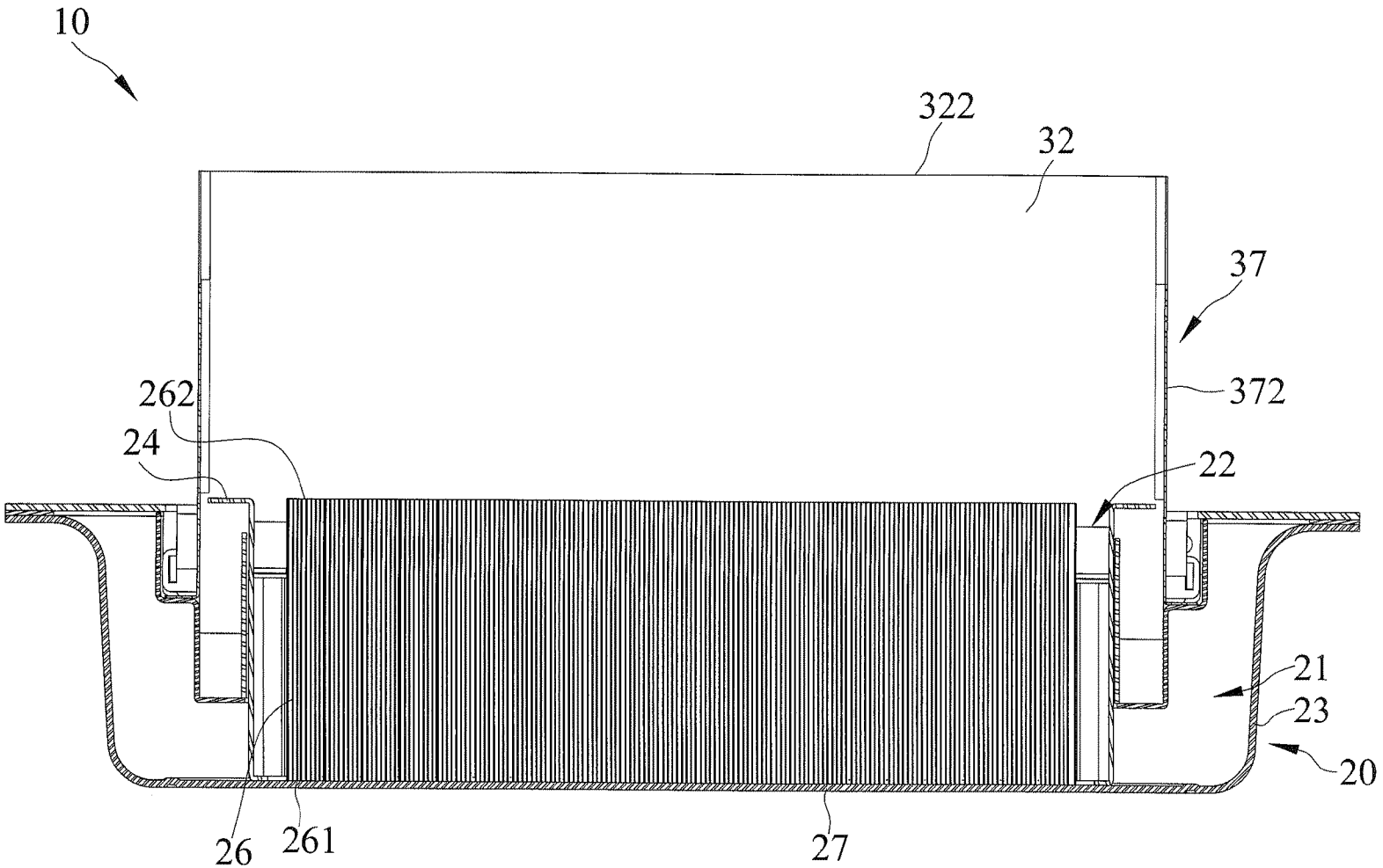
FIG. 3 is a cross-sectional view taken along line 3-3 of FIG. 1.
Figure 4:
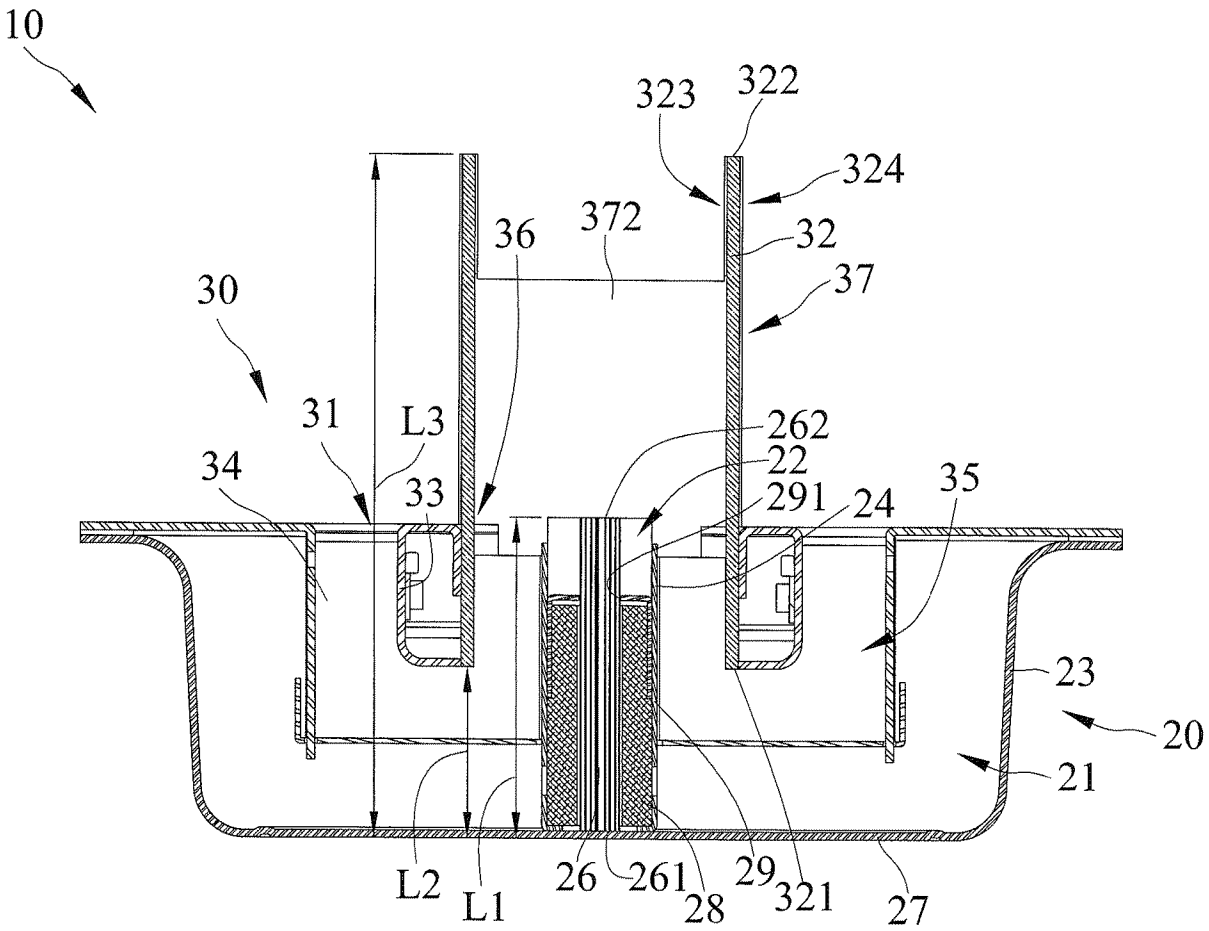
FIG. 4 is a cross-sectional view taken along line 4-4 of FIG. 1.
Figure 5:
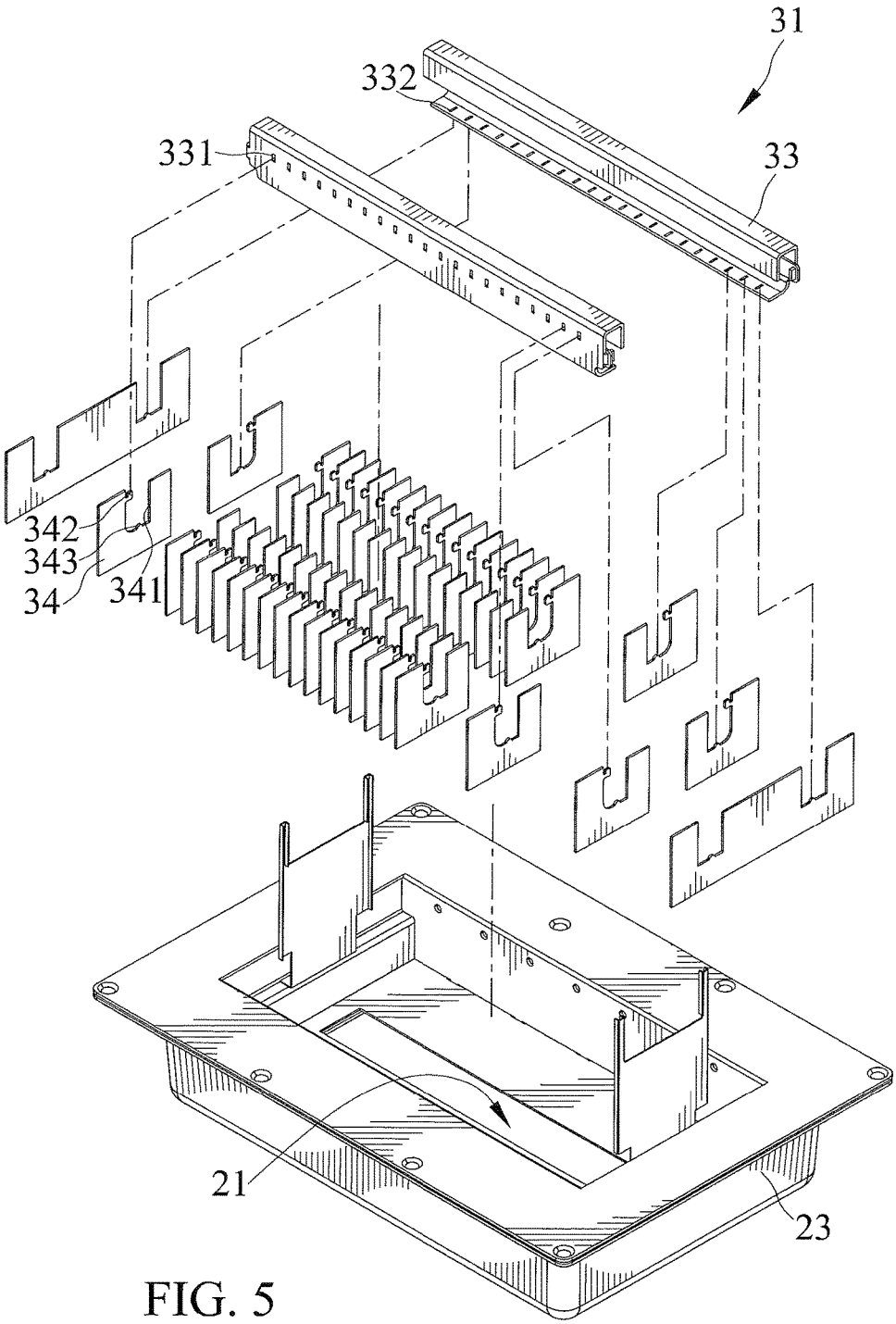
FIG. 5 is an exploded perspective view of a guiding device of the safe combustion device in accordance with the first embodiment of the present invention.
Figure 6:
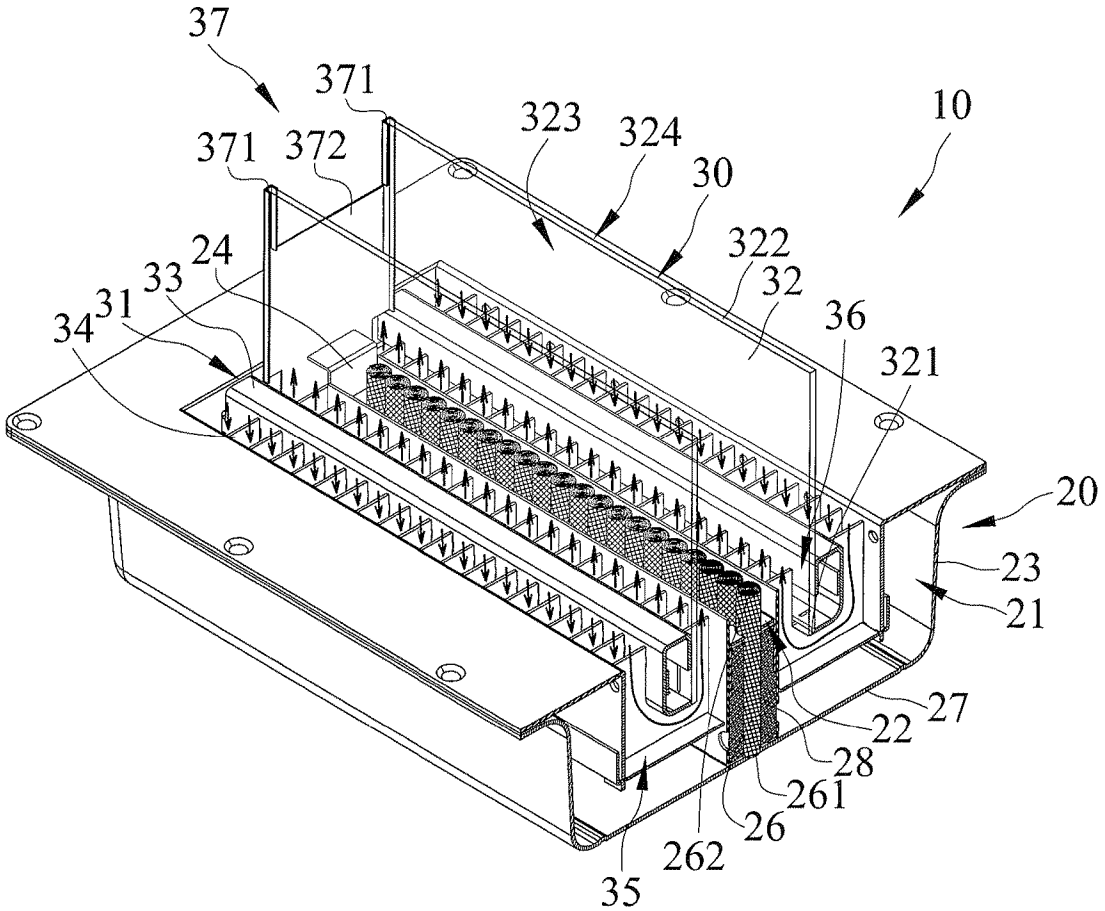
FIG. 6 shows air flowing in the safe combustion device in accordance with the first embodiment of the present invention, with arrows indicating the flow direction of the air.
Figure 7:
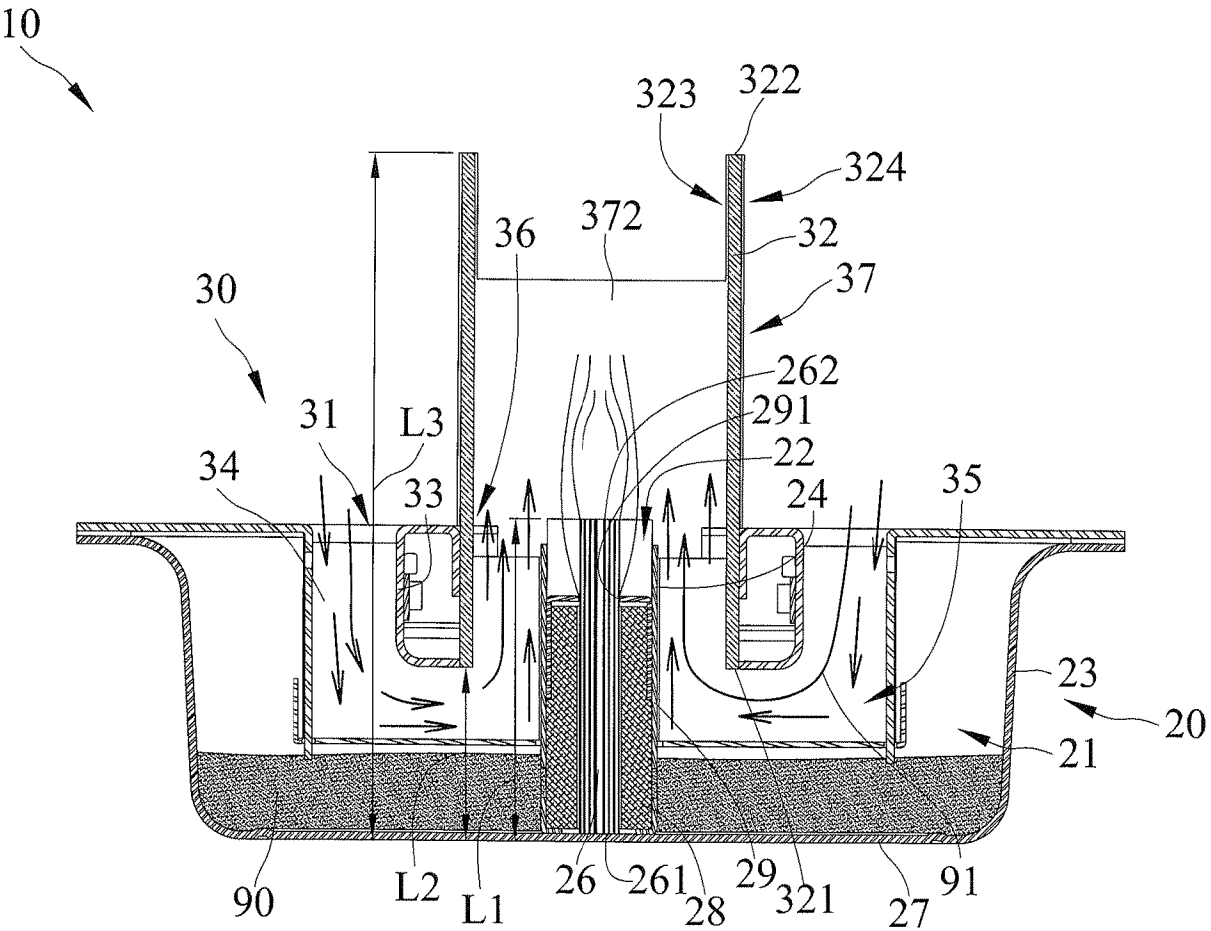
FIG. 7 is a cross-sectional view showing the safe combustion device in accordance with the first embodiment of the present invention in use, with arrows indicating the flow direction of the air.
Figure 8:
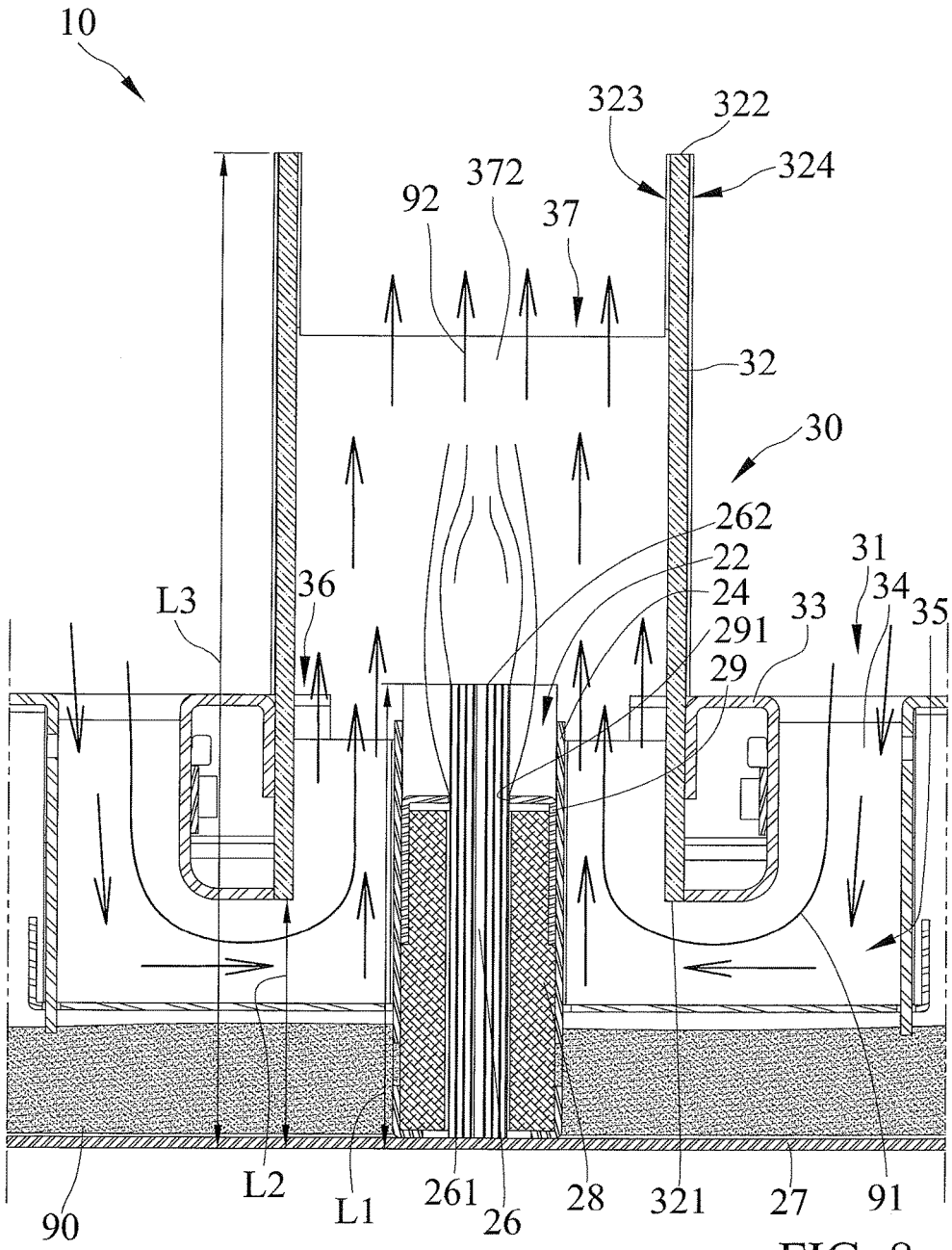
FIG. 8 is a partial, enlarged view of FIG. 7.
Figure 9:
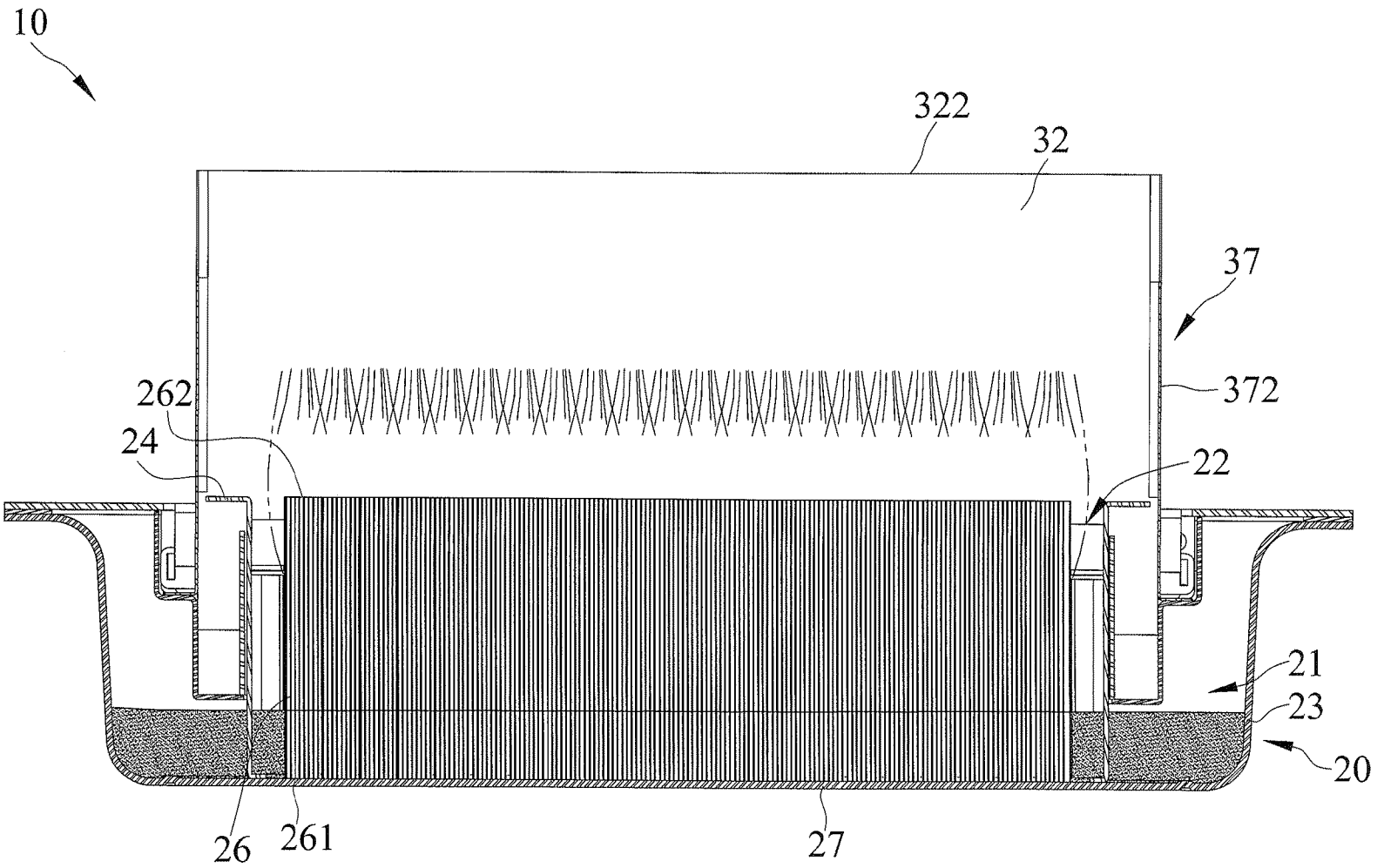
FIG. 9 is another cross-sectional view showing the safe combustion device in accordance with the first embodiment of the present invention in use.
Figure 10:
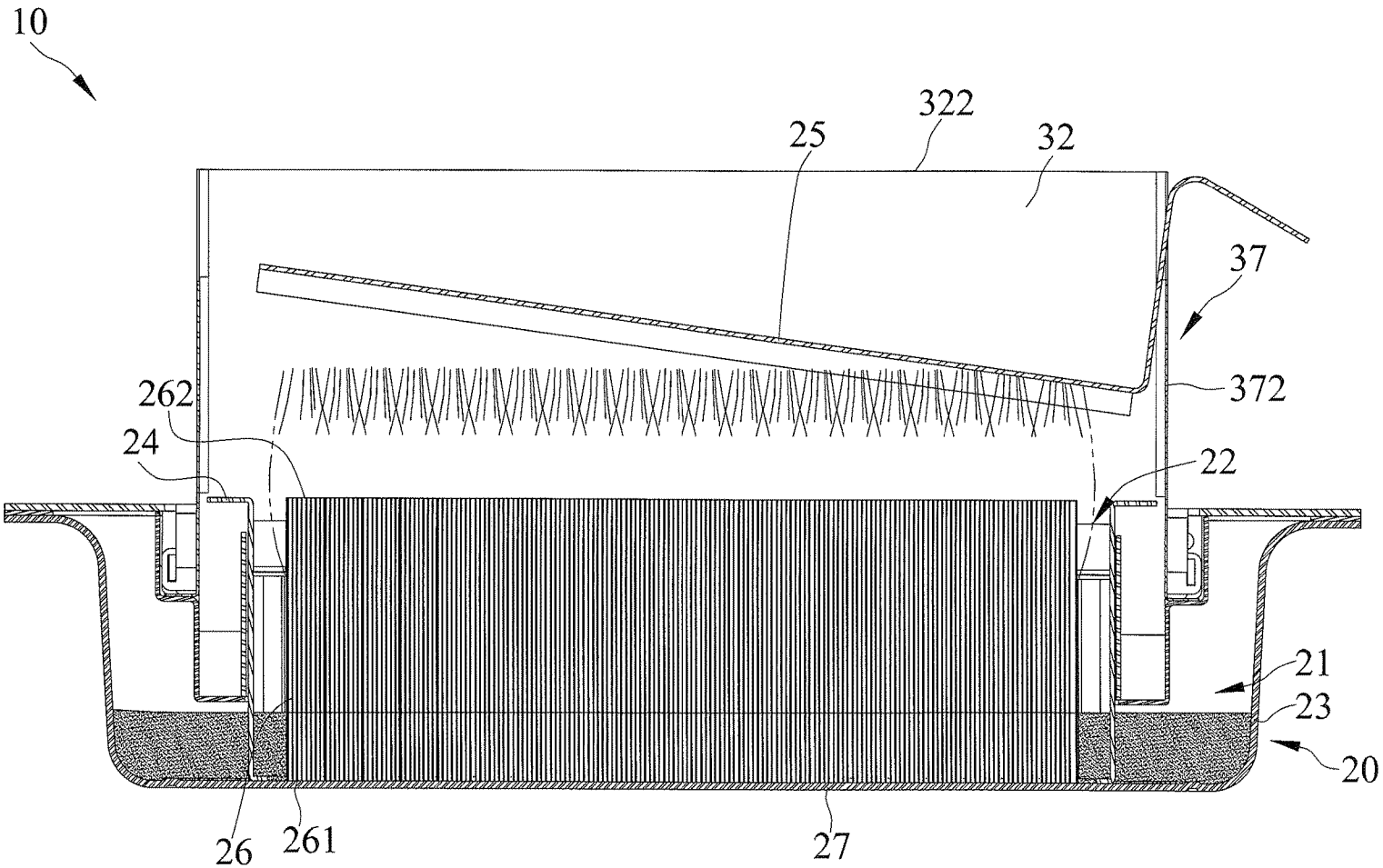
FIG. 10 is another cross-sectional view showing the safe combustion device in accordance with the first embodiment of the present invention including a cover for putting out the flame.
Figure 11:
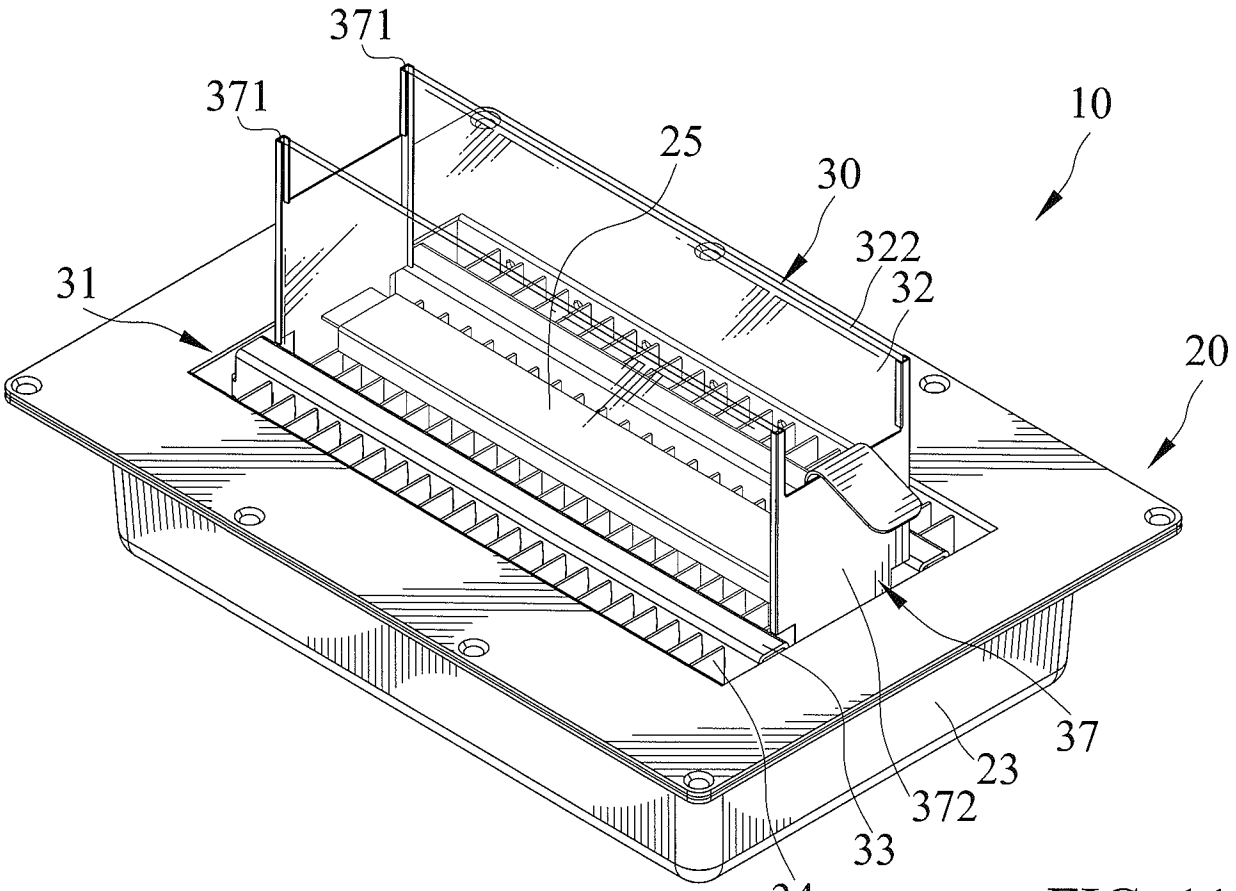
FIG. 11 is a perspective view showing the safe combustion device in accordance with the first embodiment of the present invention, with the cover in use position.

FIGS. 1 through 11 show a safe combustion device 10 in accordance with a first embodiment of the present invention. The safe combustion device 10 includes a housing 20 defining a receiving space 21. The housing 20 includes an opening 22 connecting inner and outer sides of the receiving space 21, and the inner side defines a fuel reservoir 23. The safe combustion device 10 further includes a seat 24 and a flame extinguisher 25 selectively capped on the seat 24. The seat 24 is disposed in and connects the inner side and the outer side of the housing 20 and extends through the opening 22. The seat 24 includes an end disposed in the inner side of the housing 20 and including at least one aperture extending therethrough. A wick 26 is disposed in the receiving space 21. Further, a metal form 28 circumferentially encloses the wick 26 and is disposed between the seat 24 and the wick 26. The wick 26 has a top end 262 at a first distance L1 from a bottom surface 27 of the housing 20. The wick 26 has a bottom end 261 received in the inner side of the receiving space 21, and the top end 262 of the wick 26 is received in the outer side of the receiving space 21. A flame tamer 29 is capped on the metal form 28 and includes a through hole 291. The wick 26 includes the top end 262 thereof extending through and exposed outside the through hole 291. The wick 26 has a columnar shape. The wick 26 is disposed upright with respect to the bottom surface 27 of the housing 20. The wick 26 includes a plurality of cylindrical and coiled parts, and the parts are arranged in an axial array. The wick 26 has meshes.

A guiding device 30 is connected to the housing 20 and includes at least one shade 32. The at least one shade 32 is disposed on at least one fixture device 31. The at least one fixture device 31 includes a bracket 33 and a plurality of guiding vanes 34 disposed on the bracket 33. The bracket 33 includes a plurality of first fixing ends 331 and a plurality of second fixing ends 332. Each of the plurality of guiding vanes 34 includes a recess 341 and first and second flanges 342 and 343 extending in the recess 341. The bracket 33 is disposed in the recess 341. The first flange 342 is engaged with one of the plurality of first fixing ends 331, and the second flange 343 is engaged with one of the plurality of second fixing ends 332 respectively. The recess 341 is U-shaped in cross section. The plurality of first fixing ends 331 defines a plurality of holes. Two adjacent guiding vanes 34 include a gap therebetween. The plurality of guiding vanes 34 is disposed upright on the bracket 33 and one after another axially. The at least one shade 32 has bottom and top sides 321 and 322 at second and third distances L2 and L3 from the bottom surface 27 of the housing 20 respectively. The second distance L2 is shorter than the first distance L1. The first distance L1 is shorter than the third distance L3. The at least one shade 32 has an inner lateral side 323 adjacent to the wick 26 and an outer lateral side 324 opposite the inner lateral side 323. The at least one shade 32 and the housing 20 include a flow passage 35 formed therebetween. The flow passage 35 has a length between the inner lateral side 323 of the at least one shade 32 and the wick 26, a length below the bottom side 321 of the at least one shade 32, and a length outside the outer lateral side 324 of the at least one shade 32. The bracket 33 and each of the plurality of guiding vanes 34 delimit a channel 36, and the at least one shade 32 is disposed in the channel 36.

Preferably, the at least one shade 32 includes two shades 32, and the at least one fixture device 31 includes two fixture devices 31 receiving the two shades 32, respectively. The wick 26 is disposed between the two shades 32. Further, two fences 37 are disposed between the two fixture devices 31 and the two shades 32 and opposite to each other. The wick 26 is disposed between the two fences 37. Each fence 37 is connected to the housing 20 and includes two connecting ends 371*a* connecting the two shades 32 respectively, and a surface 372 extending between the two connecting ends 371 and two shades 32.

Preferably, the at least one shade 32 is transparent.

When the safe combustion device 10 is in use, the wick 26 burns and includes the top end 262 thereof holding the flame. The wick 26 draws fuel 90 in the fuel reservoir 23 by capillary action up into the flame. The guiding device 30 avoids the outside air 91 blowing and putting out the flame. The outside air 91 that flows into the safe combustion device 10 flows in the flow passage 35, and the flow passage 35 guides the outside air 91 to flow at the inner lateral side 323 of the at least one shade 32 which is adjacent to the wick 26 and then upward without blowing the flame and causing an instability of the flame. In addition, the outside air 91 between the top end of the wick 26 and the two guiding devices 30 gets hot, decreasing the density thereof, and the two guiding devices 30 form a half closed zone, so that buoyancy occurs, thereby causing a stack effect and an updraft 92. The updraft 92 increases flow circulation speed and ventilation speed, prevents a buildup of hot air in the safe combustion device 10, and improves heat dissipation efficiency.

To put out the flame, the flame extinguisher 25 is used. The flame extinguisher 25 is capped on the seat 24. The seat 24 and the flame extinguisher 25 form a closed zone. Therefore, the top end 262 of the wick 26 is disposed in the closed zone, and the supply of oxygen to the flame is cut out.

Figure 12:
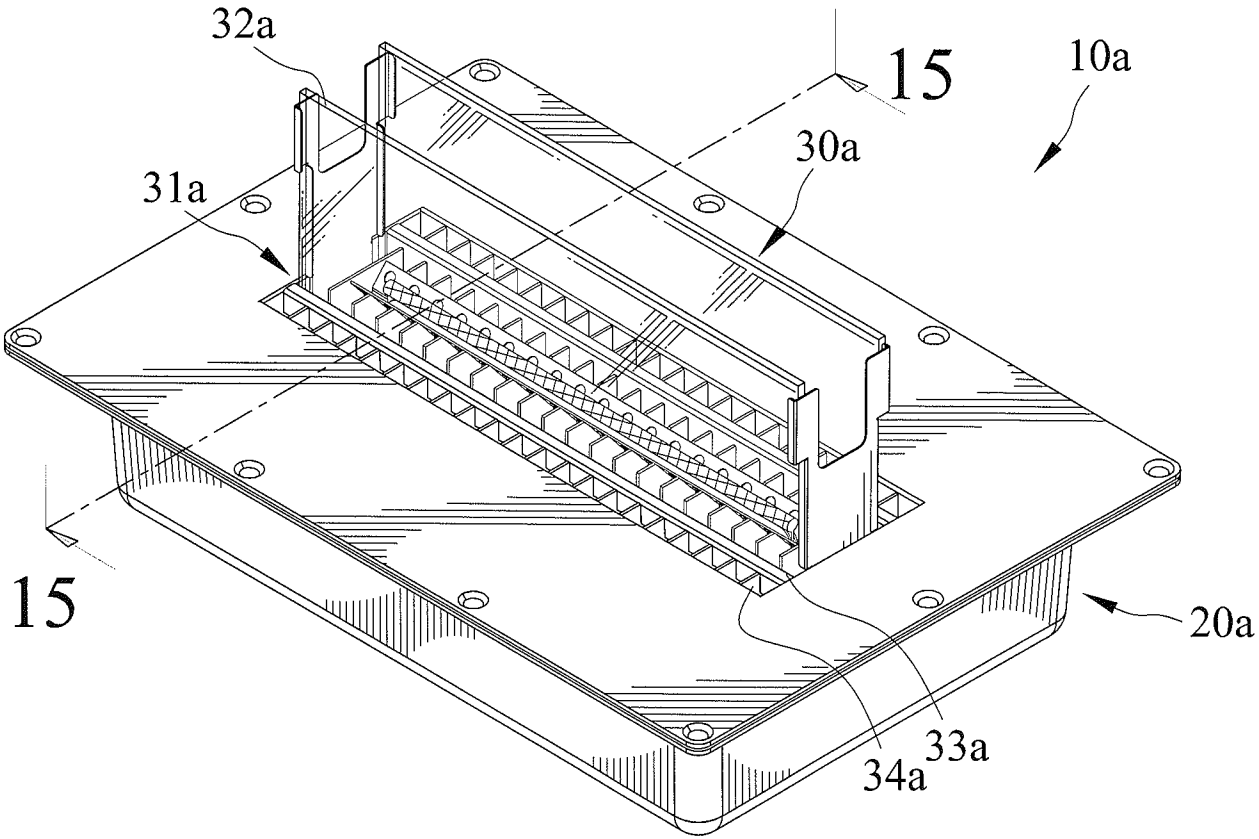
FIG. 12 is a perspective view of a safe combustion device in accordance with a second embodiment of the present invention.
Figure 13:
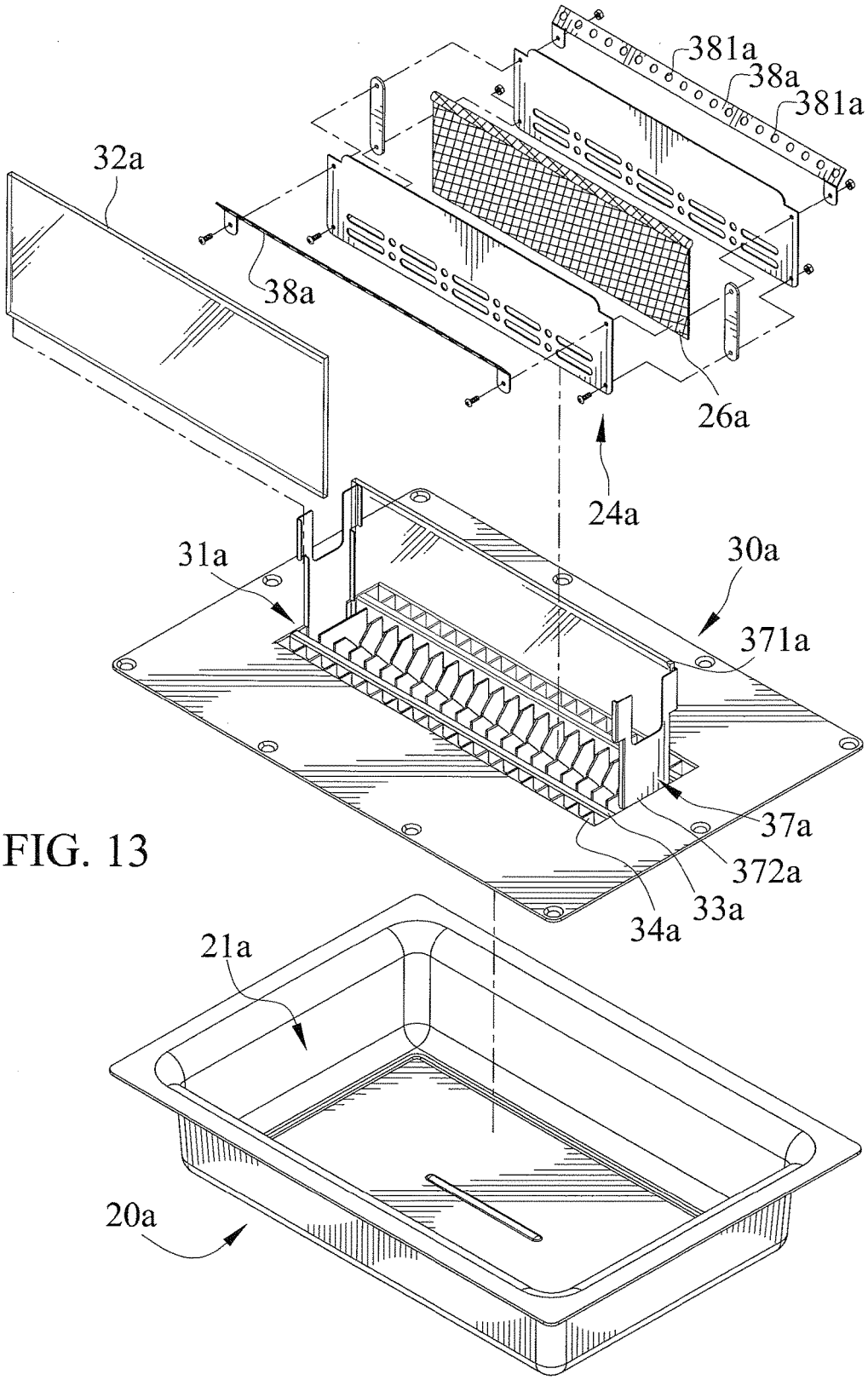
FIG. 13 is an exploded perspective view of the safe combustion device in accordance with the second embodiment of the present invention.
Figure 14:
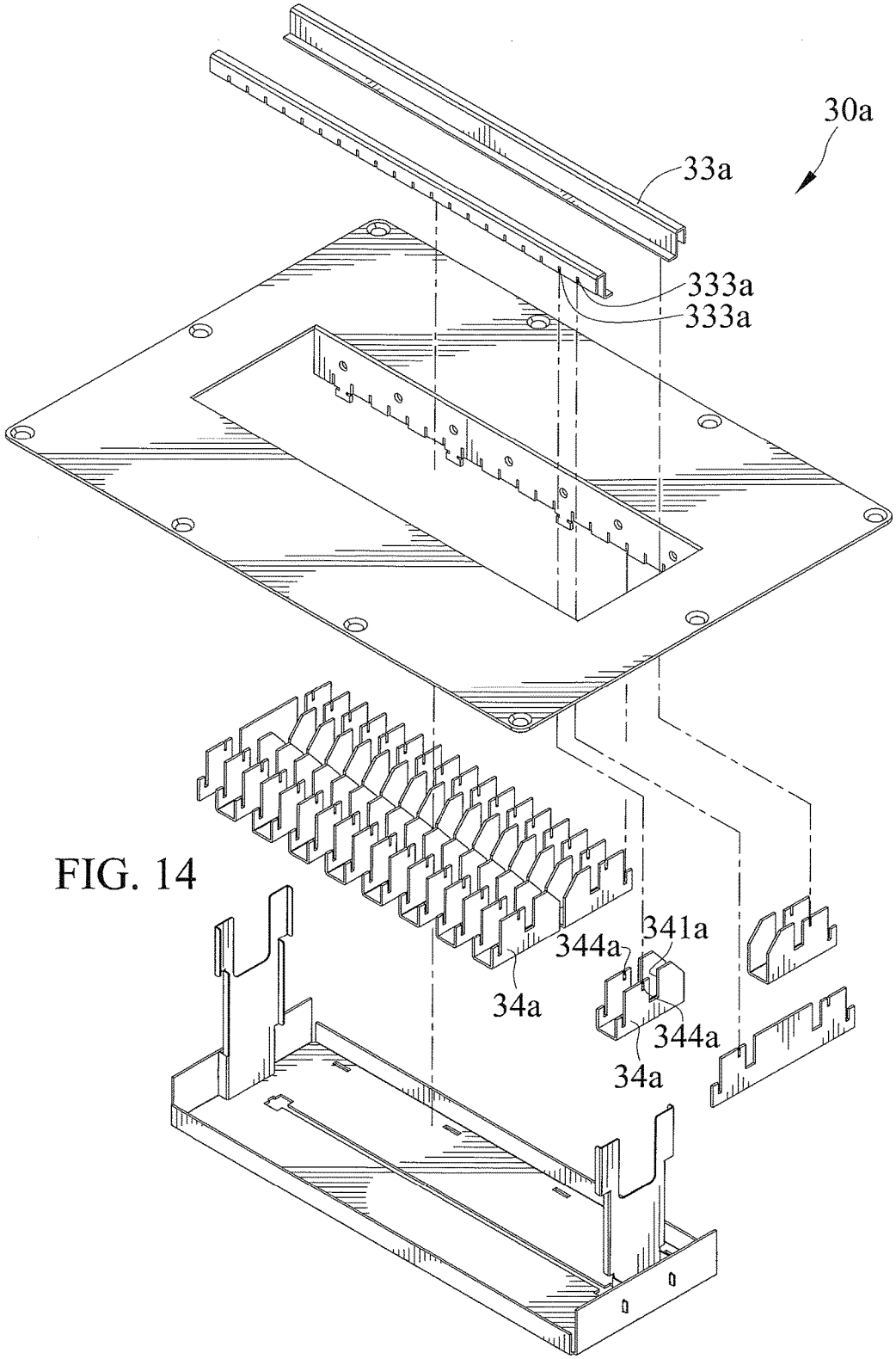
FIG. 14 is an exploded perspective view of a guiding device of the safe combustion device in accordance with the second embodiment of the present invention.
Figure 15:
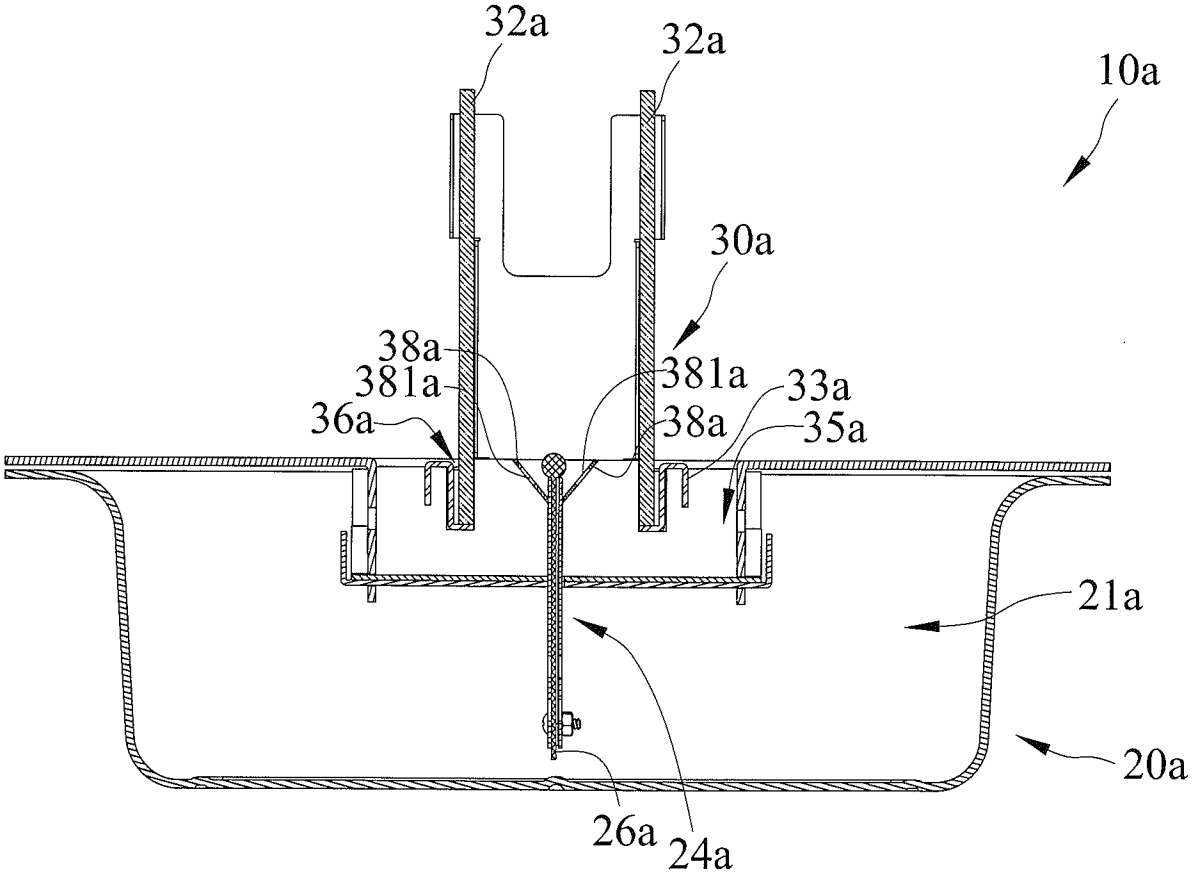
FIG. 15 is a cross-sectional view taken along line 15-15 of FIG. 12.
Figure 16:
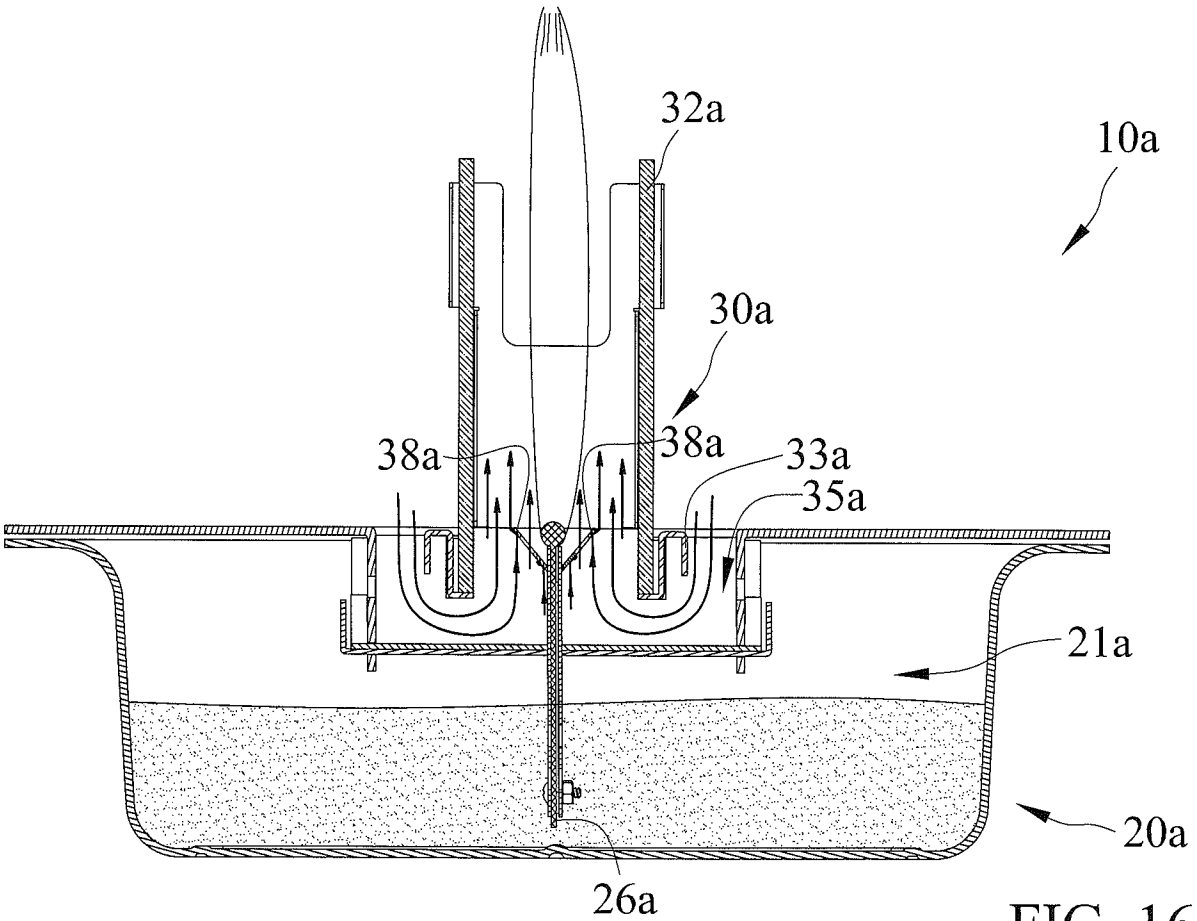
FIG. 16 is a cross-sectional view showing the safe combustion device in accordance with the second embodiment of the present invention in use, with arrows indicating the flow direction of the air.
Figure 17:
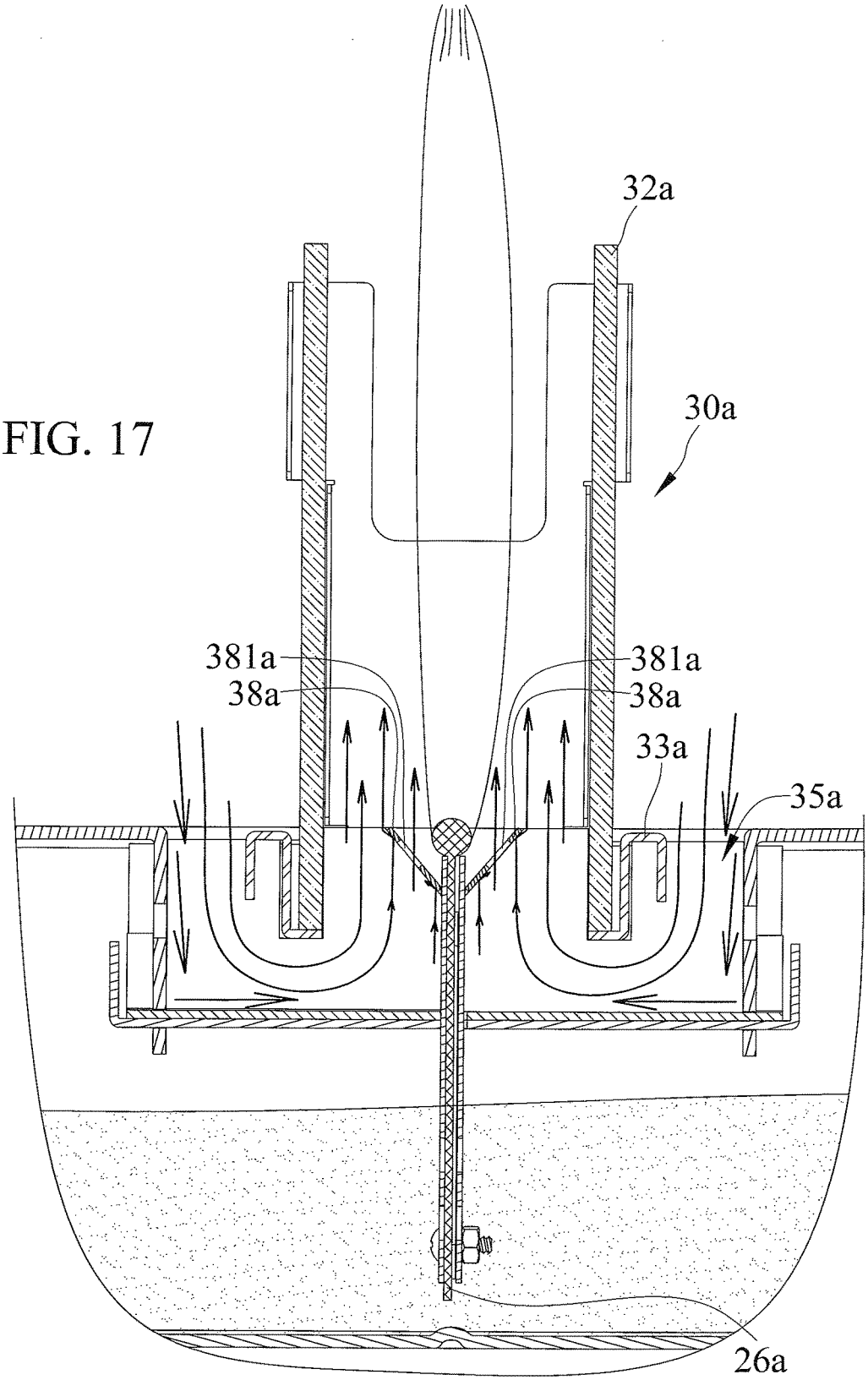
FIG. 17 is a partial, enlarged view of FIG. 7.
Figure 18:
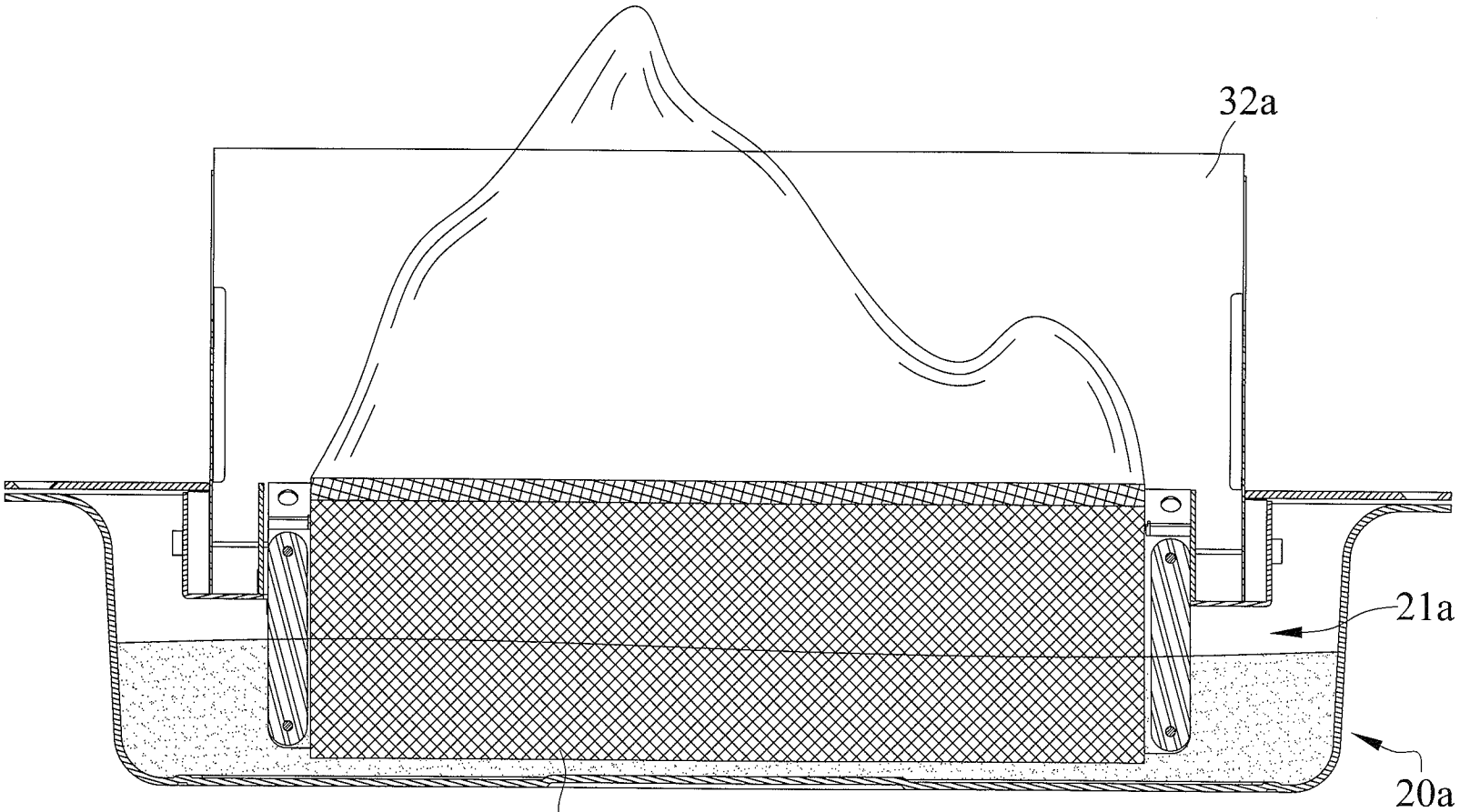
FIG. 18 is another cross-sectional view showing the safe combustion device in accordance with the second embodiment of the present invention in use.

FIGS. 12 through 18 show a safe combustion device 10*a* in accordance with a second embodiment of the present invention, and the same numbers are used to correlate similar components of the first embodiment, but bearing a letter a. Therefore, similar descriptions are not repeated.

The second embodiment is similar to the first embodiment, except a bracket 33*a* includes a plurality of joining ends 333*a* and each of a plurality of guiding vanes 34*a* includes a recess 341*a* and a slot 344*a*. The bracket 33*a* is disposed in the recess 341*a*, and the slot 344*a* is engaged with one of the plurality of joining ends 333*a*. The recess 341*a* is U-shaped in cross section. The plurality of joining ends 333*a* defines a plurality of holes. Furthermore, a guiding device 30*a* includes at least one flow guiding member 38*a* extending in a flow passage 35*a* and is disposed between a wick 26*a* and at least one shade 32*a*. The at least one flow guiding member 38*a* extends gradually upward and has an end adjacent to the wick 26*a* at a lower height and an end adjacent to the at least one shade 32*a* at a higher height from a bottom of the flow passage 35*a*. The at least one flow guiding member 38*a* includes at least one orifice 381*a* extending therethrough. Furthermore, the wick 26*a* defines a plate structure, and a seat 24 sandwiches the plate structure. Likewise, the wick 26*a* has a top end exposed from the seat 24. The top end of the wick 26 has a circular shape in cross section.

When the outside air 91 flows into the safe combustion device 10*a*, it flows in the flow passage 35*a*, and the at least one flow guiding member 38*a* will deflect the outside air 91 to blow on the wick 26*a*. In addition, the at least one orifice 381*a* permits the outside air 91 to flow therethrough, thereby preventing a buildup of hot air and poor heat dissipation.

In view of the forgoing, the safe combustion devices 10 and 10*a* allow air flow therein to flow at a faster speed. Consequently, vaporized fuel 90 can rise higher, and a flame can increase in size and height. Moreover, the safe combustion devices 10 and 10*a* allow the top ends 262 of the wicks 26 and 26*a* to achieve at a higher burning temperature, thereby having a better burning efficiency and providing a stable flame.

While the specific embodiments have been illustrated and described, numerous modifications come to mind without significantly departing from the spirit of invention, and the scope of invention is only limited by the scope of accompanying claims.

What is claimed is:

1. A safe combustion device comprising:

a housing defining a receiving space;

a wick disposed in the receiving space, with the wick having a top end at a first distance from a bottom surface of the housing; and a guiding device connected to the housing and including at least one shade, with the at least one shade having bottom and top sides at second and third distances from the bottom surface of the housing respectively, with the second distance shorter than the first distance, with the first distance shorter than the third distance, with the at least one shade having an inner lateral side adjacent to the wick and an outer lateral side opposite the inner lateral side, with the at least one shade and the housing including a flow passage formed therebetween, with the flow passage having a length between the inner lateral side of the at least one shade and the wick, a length below the bottom side of the at least one shade, and a length outside the outer lateral side of the at least one shade, wherein the guiding device includes at least one flow guiding member extending in the flow passage and disposed between the wick and the at least one shade, and wherein the at least one flow guiding member extends gradually upward and has a first end adjacent to the wick with the first end at a lower height than the top end of the wick from a bottom of the flow passage and a second end adjacent to the at least one shade at a higher height than the height of the first end from the bottom of the flow passage, wherein the at least one flow guiding member includes at least one orifice extending therethrough.

2. The safe combustion device as claimed in claim 1, wherein the guiding device includes the at least one shade disposed on at least one fixture device, and wherein the at least one fixture device includes a bracket and a plurality of guiding vanes disposed on the bracket.

3. The safe combustion device as claimed in claim 2, wherein the bracket and each of the plurality of guiding vanes delimit a channel, and wherein the at least one shade is disposed in the channel.

4. The safe combustion device as claimed in claim 3, wherein the at least one shade includes two shades and the at least one fixture device includes two fixture devices receiving the two shades respectively, and wherein the wick is disposed between the two shades.

5. The safe combustion device as claimed in claim 4, further comprising two fences disposed between the two fixture devices and the two shades and opposite to each other, wherein the wick is disposed between the two fences, and wherein each fence is connected to the housing and includes two connecting ends connecting the two shades respectively and a surface extending between the two connecting ends and two shades.

6. A safe combustion device comprising:

a housing defining a receiving space;

a wick disposed in the receiving space, with the wick having a top end at a first distance from a bottom surface of the housing; and a guiding device connected to the housing and including at least one shade, with the at least one shade having bottom and top sides at second and third distances from the bottom surface of the housing respectively, with the second distance shorter than the first distance, with the first distance shorter than the third distance, with the at least one shade having an inner lateral side adjacent to the wick and an outer lateral side opposite the inner lateral side, with the at least one shade and the housing including a flow passage formed therebetween restricting air flow solely between an entrance and an exit, with the flow passage having a length extending from the exit between a portion of the inner lateral side of the at least one shade that is located in the receiving space and the wick, a length located in the receiving space and below the bottom side of the at least one shade, and a length extending to the entrance between a portion of the outer lateral side of the at least one shade that is located in the receiving space and side of the housing that is located in the receiving space, wherein the guiding device includes the at least one shade disposed on at least one fixture device, and wherein the at least one fixture device includes a bracket and a plurality of guiding vanes disposed on the bracket.

7. The safe combustion device as claimed in claim 6, wherein the housing includes an opening connecting inner and outer sides of the receiving space, wherein the inner side defines a fuel reservoir, wherein the wick has a bottom end received in the inner side of the receiving space, and wherein the top end of the wick is received in the outer side of the receiving space.

8. The safe combustion device as claimed in claim 7, further comprising:

a seat, and a flame extinguisher selectively capped on the seat, and wherein the seat is disposed in and connects the inner side and the outer side of the housing and extends through the opening.

9. The safe combustion device as claimed in claim 8 further comprising a metal form circumferentially enclosing the wick and disposed between the seat and the wick.

10. The safe combustion device as claimed in claim 9 further comprising a flame tamer capped on the metal form and including a through hole, and wherein the wick includes the top end thereof extending through and exposing outside the through hole.

11. The safe combustion device as claimed in claim 10, wherein the wick includes a plurality of cylindrical and coiled parts, and wherein the plurality of cylindrical and coiled parts is arranged in an axial array.

12. The safe combustion device as claimed in claim 8, wherein the seat includes an end disposed in the inner side of the housing and including at least one aperture extending therethrough.

13. The safe combustion device as claimed in claim 6, wherein the bracket and each of the plurality of guiding vanes delimit a channel, and wherein the at least one shade is disposed in the channel.

14. The safe combustion device as claimed in claim 6, wherein the bracket includes a plurality of first fixing ends and a plurality of second fixing ends, wherein each of the plurality of guiding vanes includes a recess and first and second flanges extending in the recess, wherein the bracket is disposed in the recess, wherein the first flange is engaged with one of the plurality of first fixing ends, and wherein the second flange is engaged with one of the plurality of second fixing ends respectively.

15. The safe combustion device as claimed in claim 6, wherein the bracket includes a plurality of joining ends, wherein each of the plurality of guiding vanes includes a recess and a slot, wherein the bracket is disposed in the recess, and wherein the slot is engaged with one of the plurality of joining ends.

16. The safe combustion device as claimed in claim 6, wherein the length extending from the exit is parallel to the wick, wherein the length below the bottom side extends perpendicular to the wick, and wherein the length extending to the entrance is parallel to the wick.

17. A safe combustion device comprising:

a housing defining a receiving space;

a wick disposed in the receiving space, with the wick having a top end at a first distance from a bottom surface of the housing; and a guiding device connected to the housing and including at least one shade, with the at least one shade having bottom and top sides at second and third distances from the bottom surface of the housing respectively, with the second distance shorter than the first distance, with the first distance shorter than the third distance, with the at least one shade having an inner lateral side adjacent to the wick and an outer lateral side opposite the inner lateral side, with the at least one shade and the housing including a flow passage formed therebetween, with the flow passage having a length between the inner lateral side of the at least one shade and the wick, a length below the bottom side of the at least one shade, and a length outside the outer lateral side of the at least one shade, wherein the guiding device includes the at least one shade disposed on at least one fixture device, wherein the at least one fixture device includes a bracket and a plurality of guiding vanes disposed on the bracket, wherein the at least one shade includes two shades, wherein the at least one fixture device includes two fixture devices receiving the two shades respectively, and wherein the wick is disposed between the two shades; and two fences disposed between the two fixture devices and the two shades and opposite to each other, wherein the wick is disposed between the two fences, and wherein each fence is connected to the housing and includes two connecting ends connecting the two shades respectively and a surface extending between the two connecting ends and two shades.

* * * * *